US005170889A

United States Patent [19]

Cue

[11] Patent Number: 5,170,889

[45] Date of Patent: Dec. 15, 1992

[54] COUPON CADDY FOR WALL AND POCKET USE

[76] Inventor: Debra A. Cue, 8304 Ashford Blvd., Laurel, Md. 20707

[21] Appl. No.: 755,100

[22] Filed: Sep. 5, 1991

[51] Int. Cl.[5] ..... A45C 11/18

[52] U.S. Cl. ..... 206/232; 206/425; 206/806; 206/459.5; 283/36; 283/114; 229/1.5 R

[58] Field of Search ..... 206/232, 425, 38, 459, 206/806, 37; 150/147, 135, 144; 281/29, 30, 31; 283/36, 114

[56] References Cited

U.S. PATENT DOCUMENTS

| | | | |
|---|---|---|---|
| 508,394 | 11/1893 | Andrews | 206/425 |
| 635,582 | 10/1889 | Pedrick | 206/425 |
| 1,868,188 | 7/1932 | Barker | 283/114 X |
| 2,258,666 | 10/1941 | Walker | 206/425 X |
| 3,267,980 | 8/1966 | Bird | 150/135 |
| 4,135,624 | 1/1979 | Rardin et al. | 206/806 X |
| 4,260,055 | 4/1981 | Slaybaugh | 206/425 X |
| 4,420,112 | 12/1983 | Cline | 281/31 X |
| 4,429,789 | 2/1984 | Puckett, Jr. | 206/806 X |
| 4,463,848 | 8/1984 | Parker | 206/214 |
| 4,519,629 | 5/1985 | Podosek | 281/31 X |
| 4,630,843 | 12/1986 | Willat | 281/30 |
| 4,651,872 | 3/1987 | Joyce | 206/806 X |
| 4,693,368 | 9/1987 | King et al. | 206/287.1 |
| 4,730,727 | 3/1988 | Petroff | 206/425 X |
| 4,795,196 | 1/1989 | Hyun et al. | 283/36 X |
| 4,932,520 | 6/1990 | Ciarcia et al. | 281/31 X |
| 4,966,318 | 10/1990 | Dutka | 206/425 X |

*Primary Examiner*—David T. Fidei
*Assistant Examiner*—Jacob K. Ackun, Jr.
*Attorney, Agent, or Firm*—Richard C. Litman

[57] ABSTRACT

A folding wallet or coupon caddy includes a notepad and a storage envelope for coupons, together with means for hanging the opened wallet on a hook. When folded it is easily taken to the store and used there; when hung on a wall it is convenient for stuffing with coupons while leaving table space free. The envelope has loose, color coded dividers to sort the coupons into classes. The included notepad may include coordinated color coding and check boxes printed on identical removable sheets. A pen or pencil holder is included.

9 Claims, 1 Drawing Sheet

COUPON CADDY FOR WALL AND POCKET USE

FIELD OF THE INVENTION

The present invention relates to apparatus for shopping with coupons, and apparatus for organizing coupons.

DESCRIPTION OF THE PRIOR ART

Many stores, especially grocery stores and supermarkets, offer discounts on selected items if the buyer has a coupon. Coupons are clipped from newspapers, magazines or junk mail and are brought along to the store when shopping. The coupons are presented at the checkout along with the discounted items.

The great popularity of this marketing ploy with manufacturers, and the savings that can accrue to shoppers from rigorous coupon clipping, have led to a very widespread use of shopping coupons and to problems for the shoppers, who must carry and organize a plethora of coupons at home, in the market aisles, and at the checkout.

The confusion of assorted coupons has led inventors of the prior art to devices which help the overwhelmed shopper to cope.

Ninfa Giarritta, in U.S. Pat. No. 4,004,690, shows a coupon holding wallet for organizing coupons. The wallet has two rectangular panels hinged along a fold line formed of flexible material. A strap and snaps are provided to hold the wallet closed. The interior surfaces of the panels (those which meet when the wallet is closed) have on each one a plurality of coupon-holding rectangular envelopes formed of transparent sheet material. The envelopes are closed on three sides and open at their tops, and are hinged at their bottoms to a panel. The envelopes are disposed over the panels so that their sides are parallel to the panel fold, top and bottom edges perpendicular to it. The envelope tops are staggered, either by their bottoms being fastened at staggered positions or by having various lengths.

Each envelope includes a label at its top end denoting a category of coupon (e.g., "butter, margarine", "coffee, sugar, milk"). Coupons are clipped, classified, and put into the various appropriate containers; at the store the coupons are then easily available.

The use of transparent material allows the shopper to see coupons within the envelopes. However, one of a mass of coupons jammed into such an envelope is not easily seen. The plastics used for such transparent envelopes tend to easily rip and crack.

Another disadvantage of the Giarritta invention is that the envelopes, with their fixed category indicia and limited capacity, may lead to the stuffing of too many coupons into one envelope.

Ciarcia et al., in U.S. Pat. No. 4,932,520, show a waiter's order organizer wallet. The wallet has two panels with a vertical fold between. (The basic structure is like Giarritta's invention). One panel holds a notepad, such as a pad of tear-off menus. The other holds transparent pockets for wine lists and the like. The pockets have diagonal corner sub-pockets for temporary storage. A pencil or pen can be held along the fold line in a sheath comprising a short tape loop.

U.S. Pat. No. 4,591,054 issued to Carolyn Blossom shows a clutch purse having spaces for coupons and category cards to separate the coupons. The cards are divided into two classes, large master cards and smaller subset cards. There are fourteen master cards, which are both labeled and color-coded. They divide all coupons into categories such as: beverages; vegetables and fruit; one step meals; complete protein; snacks; and desserts. The subset cards further divide the coupons into sub-categories. The subset cards share the coded color of their respective master cards. The cards are held within two staggered pockets in the purse, seven master cards in each pocket. Indexing tabs extend upward to bear the labels of the respective cards. The tabs are offset from one another so that all of the master card labels are visible at once. The purse is closed with a flap which covers the pocket openings.

This invention may be hard to use because of the great number of categories and cards. Also, it lacks any provision for a shopping list or pen, which are useful while shopping.

Dorothy Martin, in U.S. Pat. No. 4,802,575, discloses a food store coupon organizer. This device resembles a tool box: it is a hard-shell hinged box with a carrying handle, 14 inches long and 4 inches wide. Inside, the organizer is equipped with a scissors, notepads, money purse, calculator, key ring, pens, and coupon storage pockets. As with the above-noted inventions, the Martin organizer uses color coding, finger tabs, and staggered pockets to help classify and retrieve the coupons.

This invention, while providing most of the implements used in coupon clipping and use, is heavy and bulky. The inclusion of so many tools is unnecessary both at home, where these implements are close at hand, and also in the store, where few will wish to look through newspapers and clip coupons.

None of the above inventions and patents, taken either singly or in combination, is seen to describe the instant invention as claimed.

While the prior art shows a variety of coupon holders and organizers, none of these devices is exactly adapted to the real needs of the coupon shopper.

The ideal device will be suited to use both in the store and also at home.

In the store, the shopper needs a grocery list, the coupons, and a means of retrieving the coupons quickly, that is, a classification scheme and corresponding storage units from which the coupons may be easily plucked.

At home, the device should aid in organizing the coupons into classes. The device should incorporate a classification system, allow the user to devise one, or incorporate a system with the possibility of modifying it for the individual needs of the shopper. There is clearly no need, at home, for the device to provide scissors, desk or table space, and other things which are already available. It should merely store the coupons according to the classification scheme. Because coupon clipping involves spreading out papers and utensils, the device should not occupy a great deal of table space.

Accordingly, one object of the present invention is a coupon caddy which includes the minimum elements needed for convenient coupon shopping, to avoid bulk and weight.

Another object of the present invention is a coupon caddy that is adapted to home use, particularly in occupying a small area on a table or desk.

These and other objects of the present invention will become readily apparent upon further review of the following specification and drawings.

SUMMARY OF THE INVENTION

The present invention is a coupon caddy for organizing and storing market coupons. At the store, the caddy acts as a wallet; at home, it hangs on the wall.

The caddy includes a grommet or other hanging means, by which it can be hung on a nearby vertical surface when clipping coupons. This is convenient, since coupon clipping requires an extensive area.

The caddy when extended for wall use is generally rectangular. It is comprised of semi-rigid panels and flexible fold lines in between the panels. The caddy may be made in the usual way of notebooks, wallets and the like, by fixing panel material to flexible backing or by trapping panel material between two sheets of flexible material.

There are two main rectangular panels in the caddy and two short ones adjoining respective main panels, plus a flap where the grommet is located. The flap may be rectangular, trapezoidal, etc. The order of panels is flap, short, main, short, main: whereby, the panels may be folded over into an open-ended box shape with the flap closed over a portion of the last main panel. VELCRO-type material, a snap, or other means on the flap and on the last main panel may be included for holding the box closed, for use as a wallet.

When hung by the grommet in the flap, the caddy panels are opened and hang in a line. One main panel has a notepad with fifty-two pages, each the same. One sheet is used per shopping trip. The sheets have eight color-coded sections for corresponding classes of shopping items, and lines within each section for particular items.

The other main panel has the coupon caddy proper, which is an open-mouthed accordion-type folder. The mouth is up when the caddy is hanging. Color-coded cards are disposed loosely within the caddy folder for dividing the folder into classes of item; the coupons are stored between the cards in the appropriate class. The colors are the same as those used on the notepad sheets. The loose cards allow the categories to expand and contract as needed, while keeping the total bulk constant, and allow for the number of categories to be easily changed.

The caddy may be on the lowermost main panel, or the upper. The former arrangement allows the caddy to be hung higher on the wall at home. The latter arrangement is best in the store, where the shopper may conveniently write upon the pad while keeping the upper panel vertical.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
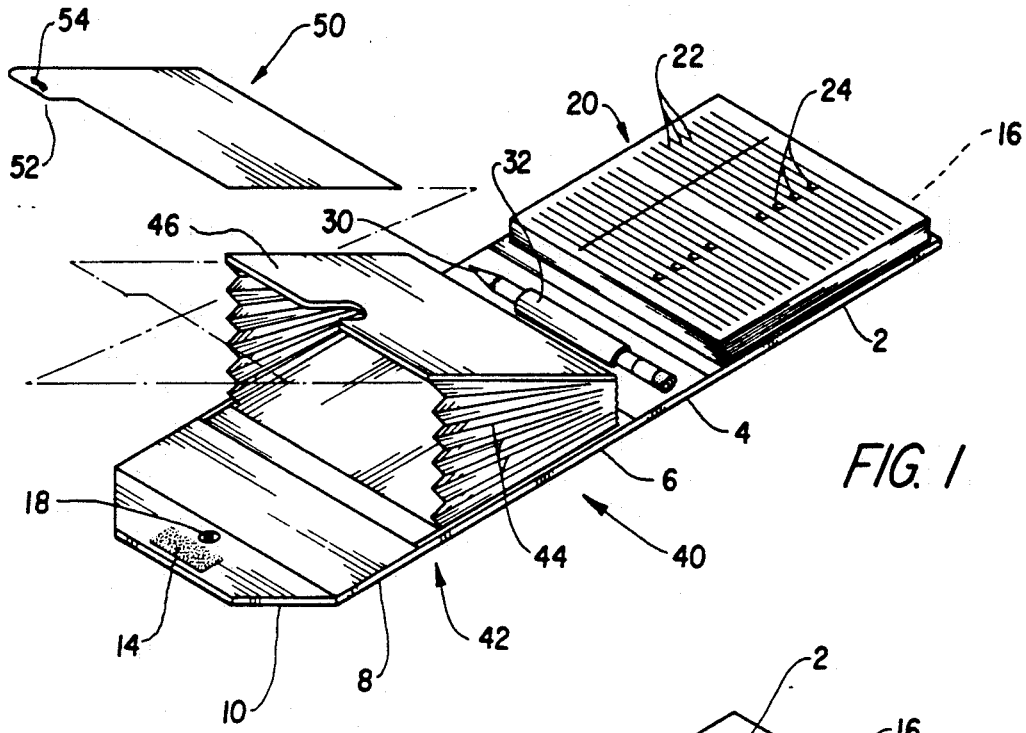
FIG. 1 is a perspective view of the invention in extended position, showing the notepad and caddy mounted upon the panels.
Figure 2:
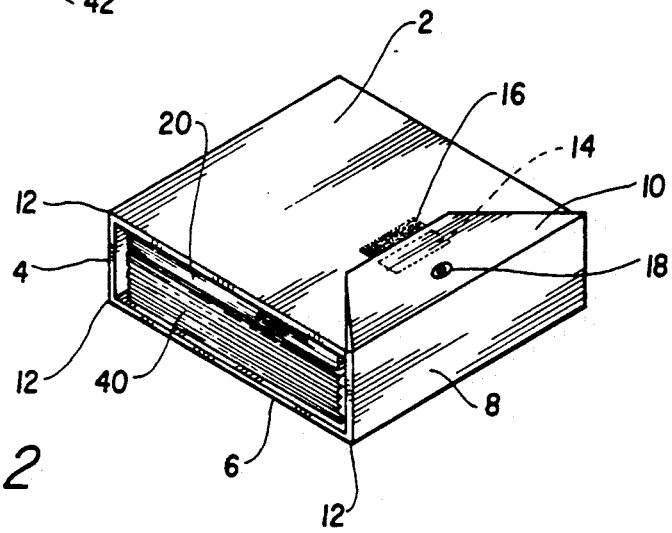
FIG. 2 is a perspective view of the invention folded up for carrying.
Figure 3:
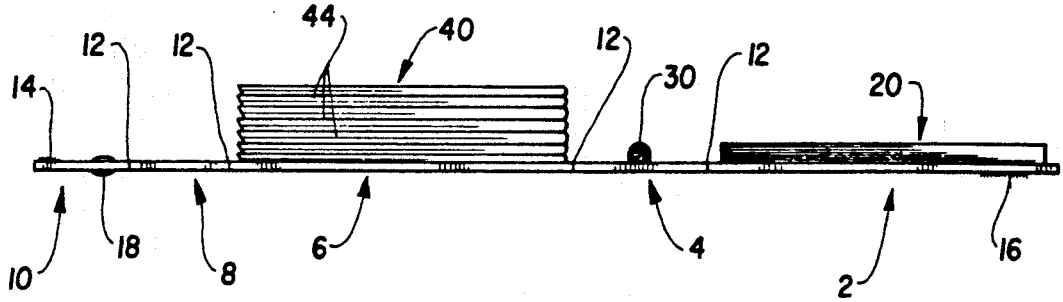
FIG. 3 is an elevational view of the invention in extended position.

The present invention, as shown in FIGS. 1–3, includes a series of panels 2, 4, 6, 8, and a flap 10. All the panels are rectangular in outline: first main panel 2 and second main panel 6 are longer panels, and connecting panels 4 and 8 are shorter panels. All the panels share a common width. The panels are relatively rotatable about fold lines 12, which are disposed between adjacent panels.

These panels, and the flap, form the cover, frame or support structure of the invention. Preferably, the cover is formed of semi-rigid material combined with flexible sheet material. For example, cardboard or plastic panel or flap sections could be fixed between two sheets of plastic, cloth, or leather. This kind of construction is widely used for such items. Alternatively, the entire structure could be flexible and depend upon the stiffness of the attached items (notepad 20, pencil 30 and caddy 40) for any needed stiffness, in the manner of an ordinary checkbook cover. As another alternative, the panels 4 and 8 may be omitted, or replaced by wide fold areas (widths of flexible material without any backing). Any cover structure which holds the attached items, and which will fold up as shown in FIG. 2, will do. The invention does not reside in the particular structure of the panels and flap.

The flap 10 may be of any suitable shape. It includes closure means for wallet use and hanging means for wall use.

The closure means shown is two strips of complementary hook and eye material (such as VELCRO) denoted 14, 16. The strip 16, on the back side of panel 2, is longer than its mating closure strip 14 on flap 10. This is to allow the invention, when used as a wallet, to be more or less tightly closed as more or fewer coupons are held in it.

The hanging means is a grommet 18, which allows the invention to be suspended on a wall from a hook, push pin, or the like. The grommet serves to reinforce the hanging hole in the flap 10. Other hanging means (such as a strip of VELCRO opposite the strip 14, which would mate with complementary VELCRO on the wall) are also possible.

The cover has an inside surface and an outside surface. The outside surface is underneath in FIGS. 1 and 3.

A notepad 20 is mounted on the inside surface of the cover first panel 2. It is used for shopping lists and notes. There are about Fifty identical tear-off pages in the pad. Each page includes eight sections, color coded, corresponding to the categories of market items. The colors may run in horizontal bands across the page. Each band includes seven horizontal writing guide lines 22. The name of an item in that category may be written on each line. Each of the seven lines has a box 24 for checking off that item once it is selected from the store shelf. After the shopping trip, the page is torn off and the underlying page is ready for use.

A pencil or pen 30 is held on panel 4 by a strap 32, for checking off the items or for adding items to the shopping list on the notepad 20 page. The strap 32 may be formed by slots cut through the material of the inside surface of the cover, or may be a separate piece joined thereto.

The coupon caddy proper, envelope 40, contains the coupons. It is mounted on the inside surface of the second panel 6. Envelope 40 has a front board 46 disposed generally parallel to panel 6. It is closed on three sides. The envelope sides have accordion pleats 44 to allow the envelope 40 to expand and contract for holding various numbers of coupons. An open mouth 42 is on a fourth side, which is uppermost when the caddy is hung upon the wall by the grommet 18.

The open mouth 42 of the envelope 40 will naturally remain upright when the caddy is held in one hand, as when writing on the notepad 20, since the panel 6 will tend to be held vertically when the panel 2 is held horizontally in one hand. For this reason, the notepad is preferably mounted on the panel 2 instead of on the panel 6.

Dividers 50 are inserted, but not fixed, within the envelope 40. The dividers 50, made of cardboard or the like, are color coded to correspond to the colors on the notepad 20. An indexing tab 52 extends from the top edge of each divider; the indexing tab 52 may include pictorial indicia 54 to show the category, for example, a schematic carrot to indicate vegetables. The tab 52 of each divider 50 is offset from the tabs of the other dividers so the shopper can see them simultaneously.

Because the dividers 50 are not fixed in place, they allow different numbers of coupons to be inserted between any two without stuffing. They can easily be changed in position and number. They will not fall out unless the coupons also fall out (in which case it does not matter that the dividers 50 have fallen out). The dividers can be turned over and new categories written on the reverse sides of the tabs 52.

It is to be understood that the present invention is not limited to the sole embodiment described above, but encompasses any and all embodiments within the scope of the following claims.

I claim:

1. A caddy for shopping coupons and notes, comprising in combination:

a cover having an inside surface and an outside surface, and including a first panel and a second panel, said cover being foldable about a first fold area to fold said second panel over and adjacent to said first panel;

a flap adjacent to said second panel, said flap being foldable about a second fold area disposed between said flap and said second panel, wherein hanging means for removably attaching said caddy from a vertical surface are disposed on said flap;

a hollow envelope, for holding coupons therein, attached to said second panel and to said inside surface, said envelope includes an openable mouth adjacent said second fold area;

a notepad attached to said first panel and to said inside surface, said notepad including a plurality of removable note pages, each of said note pages including several areas wherein said areas are color coded with mutually distinct colors corresponding to respective categories of item for easily categorizing a shopping list to be written on said note pages;

a plurality of dividers insertable into said mouth of said envelope for separating coupons within said envelope, each of said dividers colored with one of said distinct colors;

said plurality of dividers distinguished by said number of colors, with said dividers corresponding in color with said colored areas on said note pages to mutually denote with said colored areas of said dividers and said note pages the respective categories of item; whereby said panels may be folded for pocket use or extended in a straight line relative to each other when said caddy is hanging on a vertical surface from said hanging means.

2. The caddy according to claim 1, wherein said envelope includes a rectangular front board and at least one accordion pleat extending from three sides of said front board to said second panel.

3. The caddy according to claim 1, wherein said dividers include index tabs for easily categorizing the coupons into various spaces therebetween.

4. The caddy according to claim 3, wherein said index tabs include pictorial indicia representing item categories.

5. The caddy according to claim 4, wherein said indicia are color coded with mutually distinct colors corresponding to respective categories of item.

6. The caddy according to claim 1, including:

first closure means mounted on said flap and second closure means mounted on said first panel removably attachable to said first closure means for closing said cover into a closed wallet configuration.

7. The caddy according to claim 1, wherein said note pages bear indicia including writing guide lines and check boxes.

8. The caddy according to claim 1, including a writing tool holder, said holder mounted on said inside surface for removably holding a writing tool.

9. The caddy according to claim 1, wherein said cover includes a flap, and said first fold area includes a third panel between said first panel and said second panel, and said second fold area includes a fourth panel between said second panel and said flap.

* * * * *